US009115525B2

(12) United States Patent
Zimmer et al.

(10) Patent No.: US 9,115,525 B2
(45) Date of Patent: Aug. 25, 2015

(54) ADJUSTABLE ARRANGEMENT FOR DAMPING AND/OR RETARDING

(76) Inventors: Günther Zimmer, Rheinau (DE); Martin Zimmer, Rheinau (DE)

( * ) Notice: Subject to any disclaimer, the term of this patent is extended or adjusted under 35 U.S.C. 154(b) by 0 days.

(21) Appl. No.: 13/407,839

(22) Filed: Feb. 29, 2012

(65) Prior Publication Data

US 2012/0180261 A1 Jul. 19, 2012

Related U.S. Application Data

(63) Continuation-in-part of application No. PCT/DE2010/001011, filed on Aug. 30, 2010.

(51) Int. Cl.

| | |
|---|---|
| ***E05F 5/10*** | (2006.01) |
| ***E05F 5/08*** | (2006.01) |
| ***E05F 5/00*** | (2006.01) |

(52) U.S. Cl.

CPC . *E05F 5/08* (2013.01); *E05F 5/006* (2013.01); *E05F 5/10* (2013.01); *E05Y 2900/20* (2013.01); *Y10T 16/54* (2015.01); *Y10T 16/61* (2015.01)

(58) Field of Classification Search

CPC ..... E05F 5/006; E05F 5/027; E05F 5/06; E05F 5/10; E05F 5/08

USPC ..... 16/286, 362, 84, 85, 86, 68

See application file for complete search history.

(56) References Cited

U.S. PATENT DOCUMENTS

| | | | | |
|---|---|---|---|---|
| 7,552,509 | B2 * | 6/2009 | Chen et al. | 16/50 |
| 7,600,295 | B2 * | 10/2009 | Zimmer | 16/286 |
| 7,669,285 | B2 * | 3/2010 | Gallasch et al. | 16/286 |
| 7,730,582 | B2 * | 6/2010 | Migli | 16/286 |
| 7,748,082 | B2 * | 7/2010 | Harald et al. | 16/286 |
| 8,621,713 | B2 * | 1/2014 | Zimmer et al. | 16/286 |
| 2007/0157429 | A1 * | 7/2007 | Gallasch et al. | 16/238 |
| 2008/0109987 | A1 * | 5/2008 | Chen et al. | 16/68 |
| 2008/0168620 | A1 * | 7/2008 | Hammerle | 16/85 |
| 2008/0209674 | A1 * | 9/2008 | Harald et al. | 16/82 |
| 2008/0271294 | A1 * | 11/2008 | Lautenschlager | 16/374 |
| 2011/0094056 | A1 * | 4/2011 | Lautenschlager | 16/84 |
| 2013/0000075 | A1 * | 1/2013 | Forster | 16/84 |
| 2013/0055528 | A1 * | 3/2013 | Lowe | 16/85 |

FOREIGN PATENT DOCUMENTS

| | | |
|---|---|---|
| DE | 20 2005 011 752 | 11/2006 |
| DE | 20 2005 012 310 | 11/2006 |
| EP | 1 707 723 | 10/2006 |
| FR | 2 885 640 | 11/2006 |
| WO | WO 2006/088465 | 8/2006 |

* cited by examiner

*Primary Examiner* — Emily Morgan

(74) *Attorney, Agent, or Firm* — Klaus J. Bach

(57) ABSTRACT

In an arrangement for damping and retarding a movable part including a housing with a pressure member guided in the housing and a cylinder-piston unit arranged in the housing and in the pressure member. An anchoring piece is adjustably disposed in the housing and engages the pressure member in which the cylinder piston unit is arranged. The anchoring piece is connectable to the housing in at least two different positions in a form-, force- and/or material locking manner for adaptation to different installation conditions.

6 Claims, 4 Drawing Sheets

ADJUSTABLE ARRANGEMENT FOR DAMPING AND/OR RETARDING

This is a cip application of international patent application PCT/DE2010/001011 filed 30, Aug. 2010 and claiming the priority of German patent application 10 2009 039 560.1 filed 9, Jan. 2009

BACKGROUND OF THE INVENTION

The invention resides in an arrangement for damping and/or retarding a movable part, including a housing with a pressure member guided in the housing and a cylinder-piston unit arranged in the pressure member and in the housing.

EP 1 707 723 A2 discloses a damping arrangement which comprises two drives. By one drive, the cylinder-piston unit is slidable relative to the housing; by the other drive the stroke of the cylinder-piston-unit is adjustable. The forces effective during the damping of a movement are transmitted via both drives which, in the process, can be damaged.

It is the object of the present invention to develop an inexpensive adjustable damping and/or retarding arrangement for a movable part.

SUMMARY OF THE INVENTION

In an arrangement for damping and retarding a movable part including a housing with a pressure member guided in the housing and a cylinder-piston unit arranged in the housing and in the pressure member. An anchoring piece is adjustably disposed in the housing and engages the pressure member in which the cylinder piston unit is arranged. The anchoring piece is connectable to the housing in at least two different positions in a form-, force- and/or material locking manner for adaptation to different installation conditions.

The invention will become more readily apparent from the following description of schematically shown embodiments.

DETAILED DESCRIPTION OF PARTICULAR EMBODIMENTS

Figure 1:
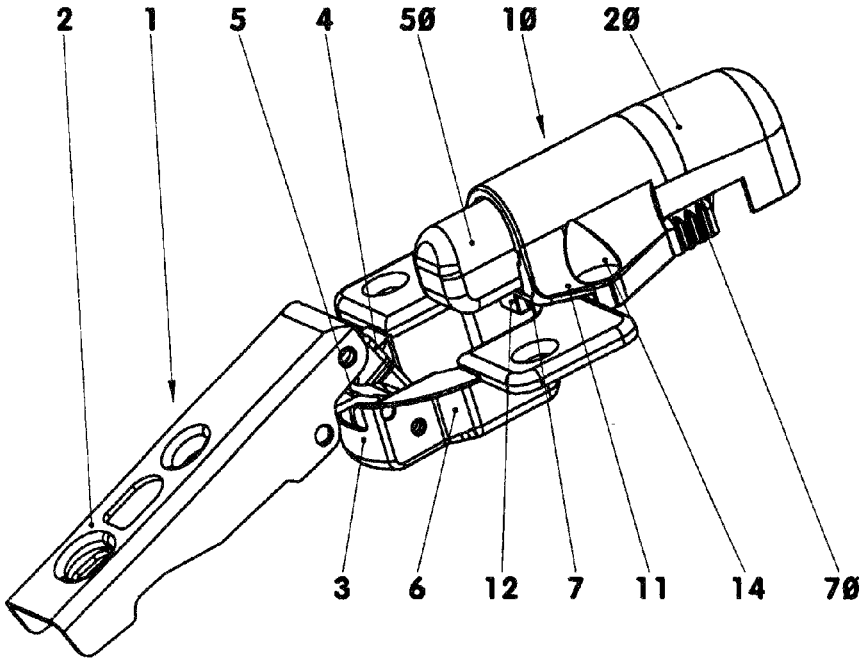
FIG. 1 shows a hinge with a damping arrangement.

FIG. 1 shows, in a perspective view, a hinge 1 with an arrangement for damping and/or retarding a member. In the particular embodiment, this is a pot hinge 1 with a damping arrangement 10 disposed on top. The pot hinge 1 has two hinge legs 2, 3 of which one (2) is for example for attachment to a furniture member and the other (3) is attached to the pivotable door of a furniture piece. The two hinge legs 2, 3 are pivotally joined by means of two hinge levers 4, 5. The pivot angle of the hinge 1 delimited by the open and closed end positions is in the shown embodiment 110 degrees. The hinge leg 2 that can be mounted in the body of the furniture member 2 is in the embodiment shown in FIG. 1, a mounting leg 2. The hinge leg 3 to be mounted to the door comprises a hinge pot 6.

The damping arrangement 10 is disposed on the hinge pot 6.

The damping arrangement 10 comprises a housing 20 a cylinder-piston-unit 40, a pressure member 50 and an anchoring piece 70. It is centered in the hinge pot 6 by means of a centering pin 12 and can be mounted by means of a mounting flange 11 for example outside the hinge pot 6 within the pivotable door panel of the furniture piece. The damping arrangement 10 may however also be attached to the hinge 1. Instead of an individual centering pin 12, the damper arrangement 10 may include two or several centering pins 12. In this way, the damping arrangement 10 may be adaptable to different types of hinge pots 6.

The damping arrangement 10 may also be mounted outside a hinge 1 for example in the door or in the body of the furniture piece. In such an embodiment, the centering pin 12 may be omitted. It is also possible to integrate the damping arrangement 10 in the hinge pot 6. For example, the housing 2 would then be firmly connected to the hinge leg 3. In this case, the mounting flange 11 is not needed.

The arrangement 10 for damping and/or retarding may also be used in connection with sliding door arrangements or other pivot or guide systems which include parts that are movable relative to one another.

Figure 3:
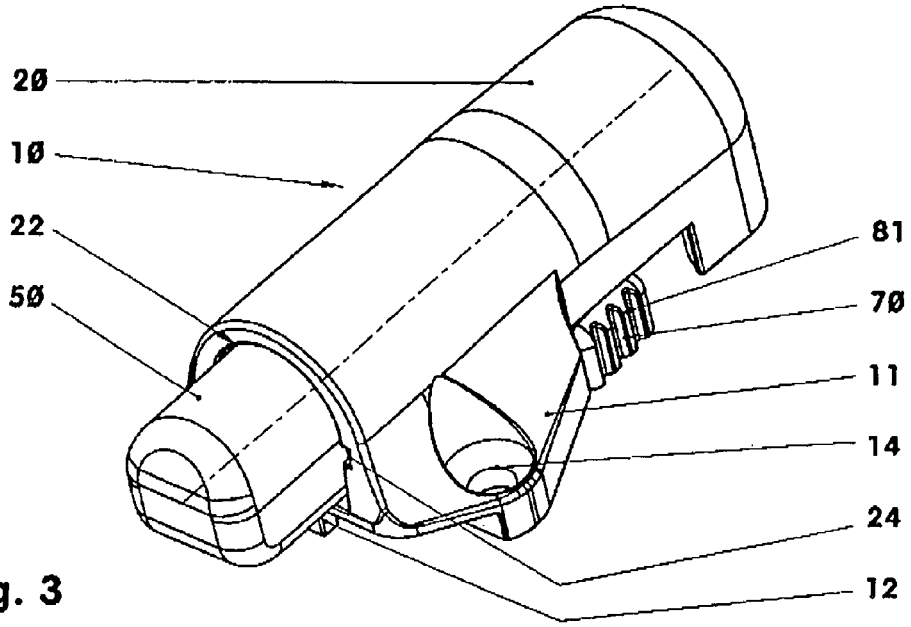
FIG. 3 is a perspective view of a damping arrangement.
Figure 4:
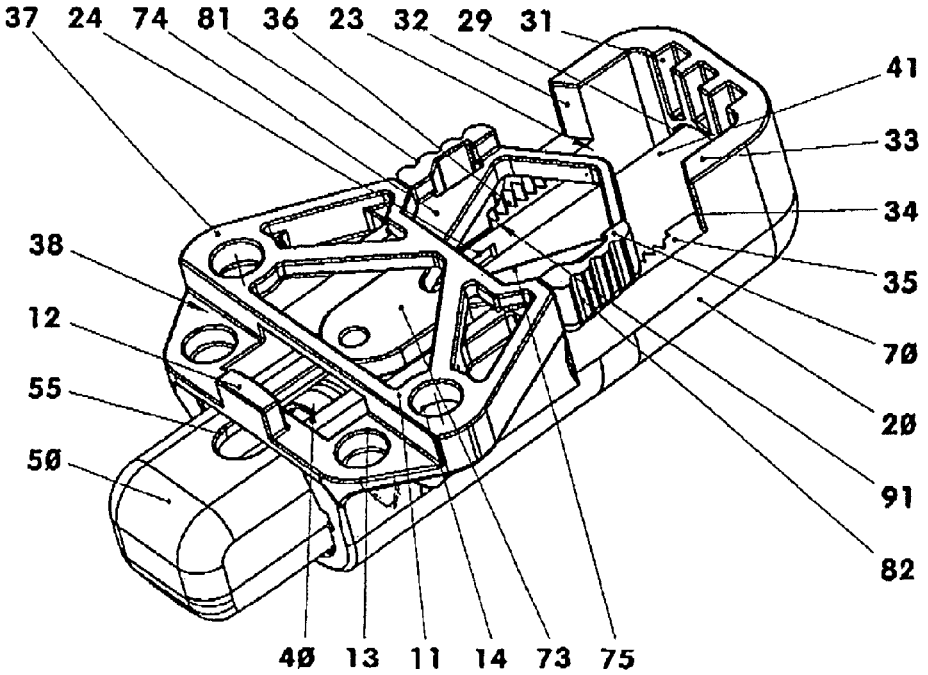
FIG. 4 is a bottom view of the damping arrangement.
Figure 5:
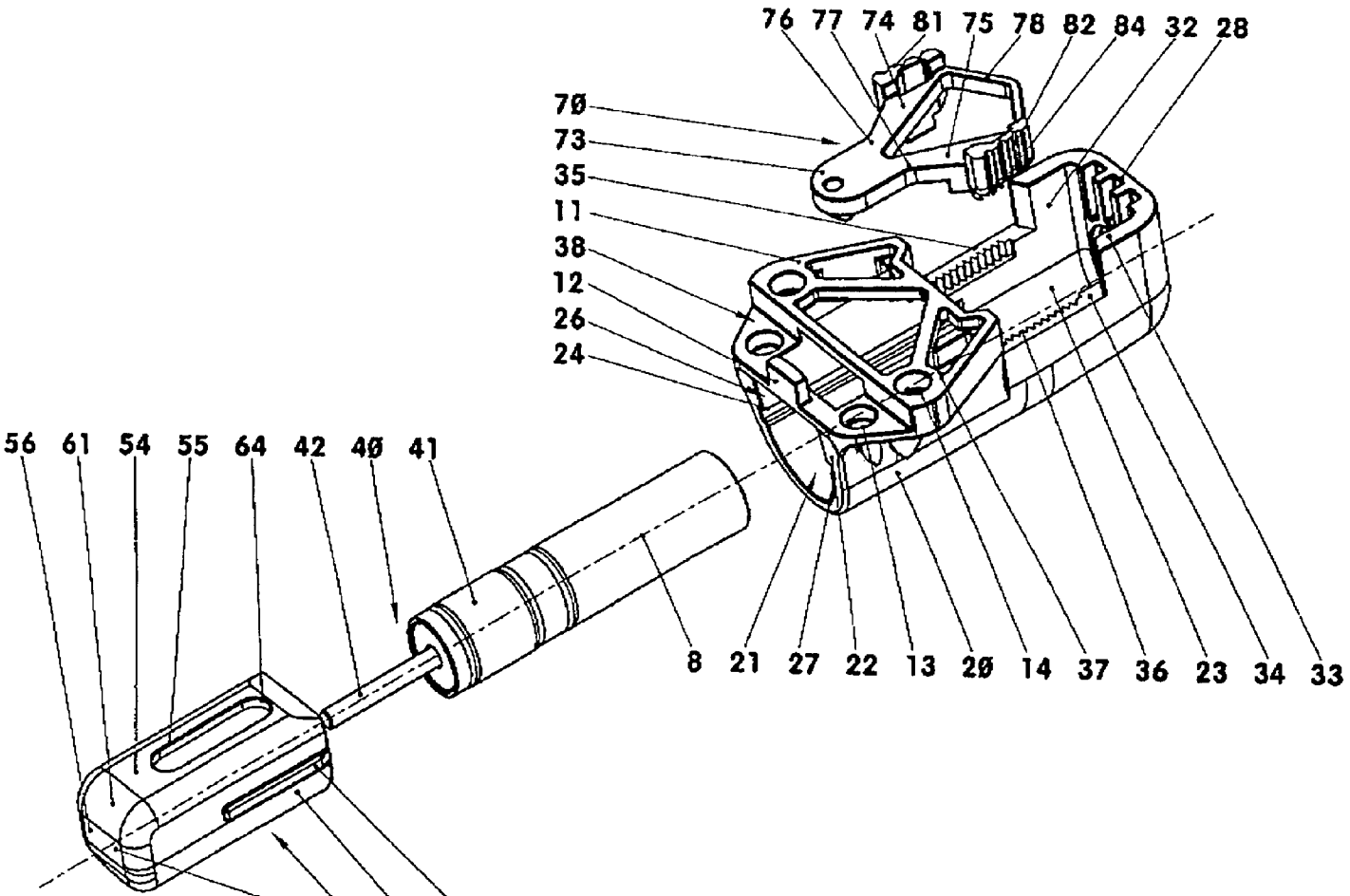
FIG. 5 is an exploded view of the damping arrangement.

FIG. 3 is a perspective view of the damping arrangement 10 of FIG. 1 as seen from above. FIG. 4 is a perspective bottom view of a damping arrangement 10 with two mounting possibilities. FIG. 5 is an exploded view of the arrangement 10 shown in FIG. 4.

In the shown embodiment, the damping arrangement has an overall length of 50 millimeters and a width in the area of the mounting flange 11 of 45 millimeters. The stroke length of the pressure member 50 relative to the housing 20 is adjustable for example between 12 millimeters and 6 millimeters. In order to shorten the stroke, the anchoring piece 70 is moved away from the pressure member 50. For increasing the stroke, the anchoring piece 70 is moved in the direction toward the pressure member 50.

Figure 6:
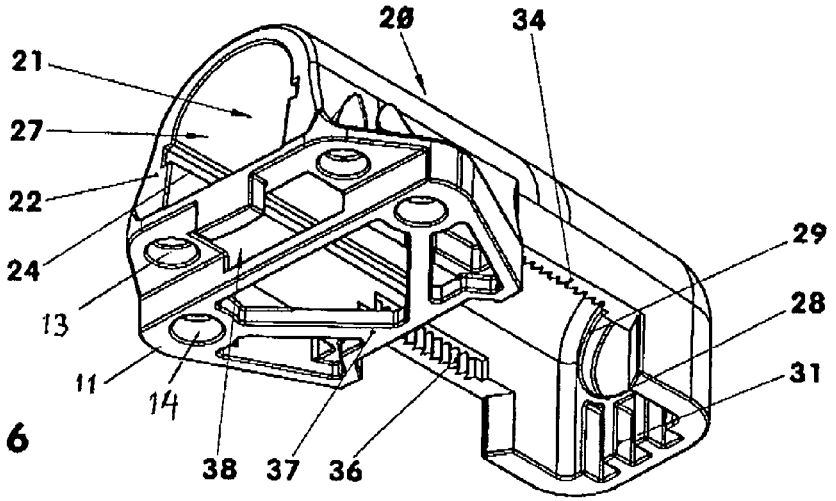
FIG. 6 shows a housing.

The housing 20 which is shown in FIG. 6 separately is an injection-molded part for example of a thermoplastic material. But it may also consist of aluminum or an aluminum alloy. It includes a semi-oval inner space 21, which is open downwardly and toward the front end 22. The wall 23 of the inner space 21 is provided with two oppositely arranged guide grooves 24, which extend up to the front end 22. Their length is for example 25 millimeter and their height is 1.3 millimeter. The guide grooves 24 are for example one millimeter deep. The distance of the opposite areas of the inner walls 23 is in the shown embodiment 12 millimeter.

The closed back wall 28 of the housing 20 has a pot-like accommodation recess 29 oriented toward the inner space 21 as well as reinforcement ribs 31. The side walls 32, 35 are provided with cut-outs 34. In the area of the inner wall 23 adjacent the base 35 of the cut-outs a tooth structure 36 is provided. This is for example a linear tooth structure with a modulus of 1.8 millimeter. The tooth width is for example three millimeters.

The housing 20 has a perforated bottom plate 37 with an accommodation groove 38 which extends transverse to the center axis 8 and a centering pin 12 which is integrally formed therewith. The length of the bottom plate 37 in the direction of the center axis 8 corresponds in the shown embodiment to about half the length of the housing 20. The bottom plate 37 additionally comprises the mounting flange 11 which has four throughbores 13, 14 in the embodiments shown in FIGS. 4-6. Two throughbores 13 are disposed in the extension of the accommodation groove 38, the other two through-bores 14 are arranged for example in the longitudinal direction of the damping arrangement 10 displaced to the outside of the groove 38. Upon mounting of the damping arrangement 10 to a pot hinge 1, the rim 7 of the hinge pot 6 is disposed in the accommodation groove 38, see FIG. 2. The damping arrangement 10 may be mounted to the hinge 1 for example by means of screws, which are inserted through the through-bores 13. By two screws inserted into the throughbores 14, the damping arrangement 10 can be mounted to a furniture piece.

Figure 7:
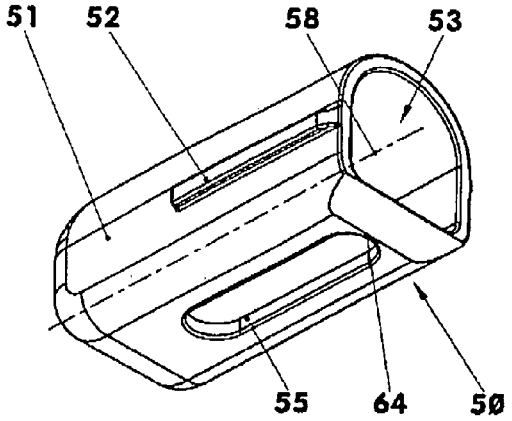
FIG. 7 shows a pressure member.

The pressure member 50 is a pot-shaped component which is open at one end. In FIG. 7, it is shown by itself. The pressure member 50 has, in the direction of the longitudinal axis 50, a length corresponding for example to 95% of the length of the guide grooves 24. Its wall thickness is for example one millimeter. The wall surface area 51 of the pressure member 50 includes two guide tracks 52 oriented in the longitudinal direction and extending up to the opening 53 of the pressure member 50. The height of this guide track 52 is for example 0.7 millimeter and its length is half the length of the pressure member 50. With these guide tracks 52, the pressure member 50 is disposed in the guide grooves of the housing 20. As a result of this large guide length, a cogging of the pressure member 50 in the housing 20 is prevented. The vertical and the lateral play of the pressure member 50 in the housing 20 are for example in each case 0.5 millimeter. In this way, for example, only a maximum angular deviation of 2.4 degrees from the center axis 8 of the damping arrangement 10 is possible.

At the bottom side 54 of the pressure member 50, an elongated opening 55 is provided. Its length is in the exemplary embodiment four thirds of the maximum stroke of the pressure member 50. The elongated opening 55 is for example four millimeter wide.

The front wall 56 opposite the opening 53 has in the exemplary embodiment a central section 57, which extends normal to the longitudinal axis 58 of the pressure member 50. Above this section 57, there is an adjacent section 59 which is inclined thereto by for example 22 degrees, see FIG. 2. In the lower area, the front wall 56 has a curved section 61. The front wall 56 may also be curved in a convex form about one or two axes or it may include an inclined planar area etc. The inner wall 62 of the front wall 56 is provided with an accommodation recess 63.

The accommodation recess 29 of the housing 20 and the accommodation recess 63 of the pressure member 50 carry the cylinder piston unit 10. The cylinder-piston unit 40 comprises a cylinder 41 and a piston which is connected to a piston rod 42 projecting from the cylinder 41. In the cylinder 41, which is filled for example with oil, a spring-biased piston which includes for example throttle valves separates a displacement chamber from a compensation chamber. The cylinder 41 is supported in the accommodation recess 29 with radial play. The piston rod 42 is disposed in the accommodation recess 63 with radial play. The radial play of the cylinder-piston unit 40 relative to the housing 20 and the pressure member 50 is for example greater than the play of the pressure member 50 relative to the housing 20. The cylinder piston unit 40 may be installed in the damping arrangement 10 in a reversed position.

Figure 2:
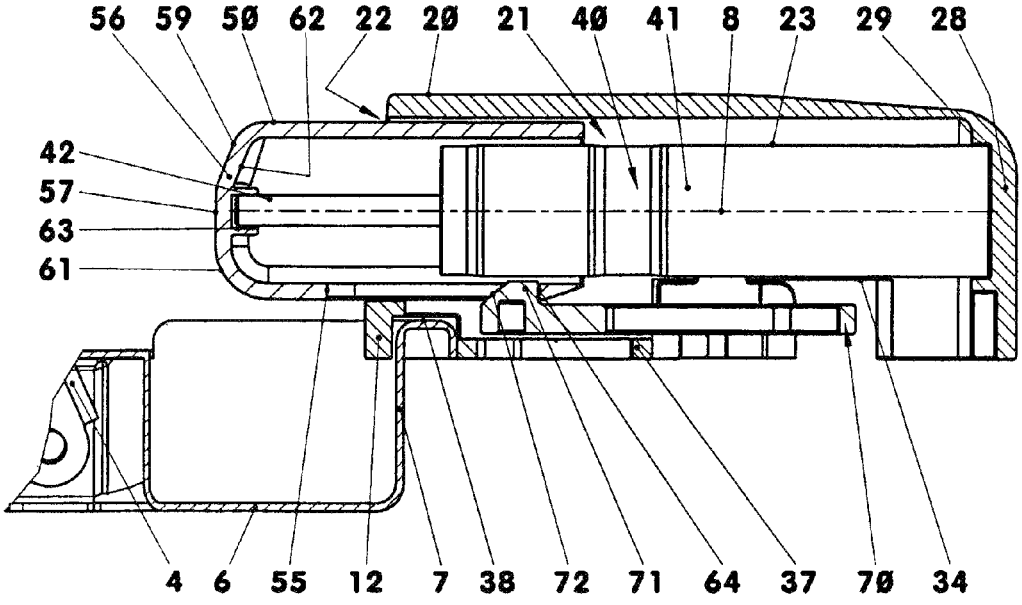
FIG. 2 is a partial longitudinal cross-sectional view of FIG. 1.

The anchoring piece 70 is disposed in the housing 20 below the cylinder piston unit 40 as shown in FIG. 2. It is also disposed above the bottom plate 37 and extends with an anchoring lug 71 into the elongated opening 55 of the pressure member 50. The anchoring lug 71 has an insertion ramp 72 in order to facilitate its installation.

Figure 8:
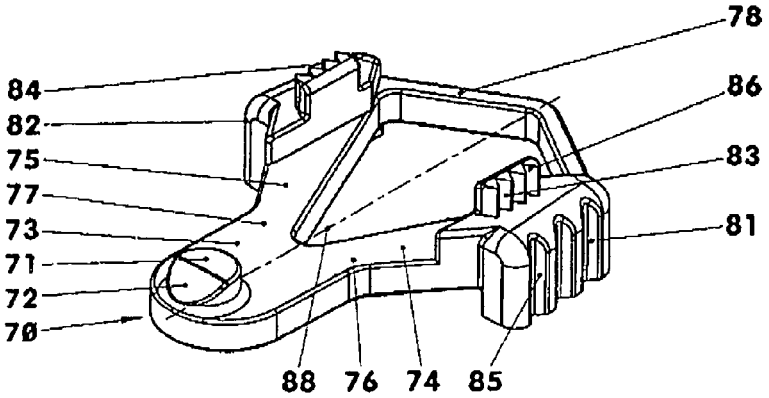
FIG. 8 shows an anchoring piece.

The anchoring piece 70 shown in FIG. 8 as a separate component has in a top view a rhombic shape which is symmetrical relative to a vertical plane extending through the center axis 88. It consists for example of a thermoplastic plastic material manufactured for example by an injection molding process. The anchoring lug 71 is disposed on a carrier plate 73. Two engagement arms 74, 75 extend from the carrier plate 73 via curved transition areas 76, 77 so as to be elastically deformable.

At their ends remote from the carrier plate 73, the two engagement arms 74, 75 are interconnected by a V-like angled web 78, which is also elastically deformable. The web 78 however may be omitted or it may also be replaced for example by a compression spring.

The engagement arms 74, 75 carry outwardly projecting engagement elements 81, 82 and, displaced therefrom gear rack segments 83, 84. The length of the engagement elements 81, 82 is for example half the length of the cut-outs 34 of the housing 20. In the exemplary embodiment, the engagement elements 81, 82 are provided with V-shaped grooves 85 which extend normal to the longitudinal direction 88 in order to prevent a sliding off of the fingers.

In FIG. 8, the gear rack segments 83, 84 are shown disposed above the engagement elements 81, 82. They are also displaced relative thereto toward the center axis 88 and have for example four teeth 86 each. The modulus of the gear rack segments 83, 84 corresponds to the modulus of the gear structures 36.

In the assembled state, the gear rack segments 83, 84 are in engagement with the gear structures 36. They establish therewith a form-locking connection between the anchoring element 70 and the housing 20. This form-locking connection 91 may be pre-tensioned.

The form-locking connection may also be established by means of cap-shaped, trapezoidal, saw-tooth shaped or semi-spherical etc. elements. It is also possible to establish the connection by means of an engagement pin or a security pin. The anchoring piece 70 and the housing 20 then have for example cavities or bores for accommodating the engagement or security pin.

For assembling the damping arrangement 10, for example, first the cylinder-piston unit 40 is inserted into the housing 20. Then the anchoring piece 70 is introduced into the housing 20 from the bottom thereof, so that the anchoring lug 71 points toward the inner space 21 of the housing 20. Finally, the pressure member 50 is installed so that the anchoring lug 71 is accommodated in the elongated opening 55. However, the assembly may also be performed in another sequence.

The damping arrangement 10 consists only of four parts, that is, the housing 20, the cylinder-piston unit 40, the pressure member 50 and the anchoring piece 70. It can therefore be manufactured inexpensively and can be assembled in an automated manner without special tools.

The pressure member 50 and the cylinder 41 of the cylinder-piston unit 40 may also be formed as a single component. The elongated opening 55 may then be an oval recess in the cylinder extending in the direction of the longitudinal axis 58. The piston rod 42 is supported in this embodiment in the housing 20.

The damping arrangement 10 assembled in this way can be placed onto the hinge 1 so that the centering pin 12 extends into the hinge pot 6. The damping arrangement 10 is attached to the door panel for example by means of screws which extend through the throughbores 14.

Upon closing of the furniture door, the two hinge legs 2, 3 pivot relative to each other. The pressure member 50 approaches the hinge mounting leg 2. As soon as the pressure member 50 contacts the mounting leg 2 or the outer hinge lever 4, the pressure member 50 is moved inwardly. In the process, it slides along the hinge leg 2 or the outer hinge lever 4. The pressure member 50 thereby moves the piston rod 42 with the piston inwardly. In the process, the elongated opening 55 is moved relative to the stationary anchoring piece 70. With a possibly non-centric force application, the guide arrangement 24, 52 takes up the transverse force components so that the cylinder piston unit 40 is subjected to forces only in the direction parallel to the piston rod. The piston rod seal is therefore not subjected to transverse forces which could cause leaks. Upon insertion of the piston, for example, the hydraulic or pneumatic medium is displaced in a throttled manner and the speed of the door panel is reduced. This retardation is larger, the larger the angular pivot speed is. The force transmitted to the cylinder piston unit 40 is transferred to the housing 20 and from there via the mounting flange 11 to the furniture door. The anchoring piece 70 remains free of stresses.

Upon opening the door, the pressure member 50 is moved away from the hinge leg 2 or from the outer hinge lever 4. For example, the spring arranged in the cylinder 41 pushes the piston with the piston rod 42 and the pressure member 50 outwardly. The elongated opening 55 moves thereby along the anchoring piece 70 until its rear edge 64 abuts the anchoring lug 71. The anchoring lug 71 then prevents further outward movement of the pressure member 50. It forms accordingly a stop for the extended position of the damper arrangement 10.

During installation of the door panel, the damper arrangement 10 may be adjusted. For the adjustment of the arrangement 10, the residual closing force to be applied by the operator is set. The residual closing force is the force which is required for a self-closing mechanism or an operator after the retardation of the door panel to completely close the door panel after it has been slowed down.

The adjustment of the apparatus 10 depends for example on the mass moment of inertia of the door panel. If the door panel has a small moment of inertia for example because of a low mass or a center of gravity which is close to the pivot axis, the stroke length of the arrangement may be increased. Also, with the use of the arrangement 10 in connection with a door panel with a high inertia mass moment, the stroke length of the arrangement 10 may be increased in order to prevent for example the door panel hitting the door lock forcefully.

This adjustment is generally performed only once during installation of the damping arrangement 10. A subsequent adjustment by the user is not necessary.

In order to reduce the stroke length of the arrangement 10 first the engagement elements 81, 82 of the anchoring piece 70 are compressed. The form-locking connection 11 is released thereby as the gear rack segments 83, 84 are disengaged from the gear structure 36. The engagement arms 74, 75, the transition areas 76, 77 and the web 78 are elastically deformed in the process. The anchoring piece 70 can now be displaced rearwardly toward the housing back wall 28. In the process, the anchoring part 70 pulls the pressure member 50 backward by means of the anchoring lug 71 disposed in the elongated opening 55. As soon as the engagement elements 81, 82 are released, the engagement arms 74, 75, the transition areas 76, 71 and the web 78 re-assume their original positions. The gear rack segments 83, 84 re-engage in the gear structure 36 and provide again for a form-locking connection 91 between the anchoring piece 70 and the housing 20. No tools are necessary for this adjustment of the arrangement 10.

If appropriate, cement-containing microspheres may be disposed on the gear structure 36 and/or the gear rack segments 83, 84. During establishing of the connection 91, those microspheres are destroyed so that the cement contained in the microspheres is released and the two adjacent surface areas are firmly interconnected in a material-locking manner. For example, a cement may be used herein which solidifies only five minutes after its release onto the surfaces in contact with each other. In this way, an adjustment can still be corrected after the original setting. A material locking connection 91 is then additionally provided.

It is also possible to interconnect the anchoring piece 70 and the housing 20 only in a material locking manner. The gear structure 36 and the gear rack segments 83, 84 are then unnecessary. Also a force-locking connection could be provided. If appropriate this could be combined with an additional material locking connection.

After the adjustment of the damping arrangement 10, the pressure member 50 can be extended only up to the position in which the rear edge 64 of the elongated opening 55 abuts the anchoring lug 71. During closing of the door panel, the retardation of the door panel is then effective in a reduced pivot range adjacent the closed end position. During operation of the damping arrangement 10, the anchoring piece 70 and the engagement structures 36, 83; 36; 84 still remain stress-free. The forces transmitted during the damping to the housing 20 are transferred to the mounting flange 11. The form-, force- and/or material locking connection remains free from stress forces.

If the pivot range in which the damping is effective is to be increased the anchoring piece 70 is moved in the opposite direction, that is, in the direction toward the hinge pot 6 and is locked in this position. This is done in the same way as described above for the adjustment of the arrangement 10.

The arrangement 10 can therefore be used in connection with door panels of the different inertia mass moments. Because of the large application range obtained thereby a particular hinge can be manufactured in large numbers. The bore arrangement for mounting the arrangement 10, for example, on the hinge, on the door panel, on the furniture body or the door frame may be independent of the mass inertia moment of the particular door panel.

In place of the arrangement 10 described, also a deceleration arrangement may be used wherein for example air is discharged from the displacement chamber to the ambient. The return movement of deceleration arrangement then occurs for example by means of a spring.

The arrangement for damping and/or decelerating 10 may also be arranged at the open end position of two parts which are movable relative to each other, such as a sliding or pivot door.

Also combinations of the various exemplary embodiments are possible.

| Listing of reference numerals: | |
|---|---|
| 1 | Hinge |
| 2 | Hinge leg |
| 3 | Hinge leg |
| 4 | Outer hinge lever |
| 5 | Inner hinge lever |
| 6 | Hinge pot |
| 7 | Rim of hinge pot |
| 8 | Center axis |
| 10 | Damping arrangement |
| 11 | Mounting flange |
| 12 | Centering pin |
| 13 | Bore |
| 14 | Bore |
| 20 | Housing |
| 21 | Inner space |
| 22 | Front side |

-continued

| Listing of reference numerals: | |
|---|---|
| 23 | Wall |
| 24 | Guide groove |
| 26 | Wall area |
| 27 | Wall area |
| 28 | Backwall |
| 29 | Accommodation recess |
| 31 | Reinforcement ribs |
| 32 | Side wall |
| 33 | Side wall |
| 34 | Cut out |
| 35 | Cut out base |
| 36 | Gear structure |
| 37 | Bottom plate |
| 38 | Accommodation groove |
| 40 | Cylinder-piston unit |
| 41 | Cylinder |
| 42 | Piston rod |
| 50 | Pressure member |
| 51 | Wall surface area |
| 52 | Guide tracks |
| 53 | Opening |
| 54 | Bottom side |
| 55 | Elongated opening |
| 56 | Front wall |
| 57 | Central section |
| 58 | Longitudinal axis |
| 59 | inclined section |
| 61 | Curved section |
| 62 | Inner wall |
| 63 | Accommodation recess |
| 64 | Rear edge of elongated opening |
| 70 | Anchoring piece |
| 71 | Anchoring lug |
| 72 | Insertion ramp |
| 73 | Carrier plate |
| 74 | Engagement arm |
| 75 | Engagement arm |
| 76 | Transition area |
| 77 | Transition area |
| 78 | Web |
| 81 | Engagement element |
| 82 | Engagement element |
| 83 | Gear rack segment |
| 84 | Gear rack segment |
| 85 | V-shaped groove |
| 86 | Teeth |
| 88 | Center axis |
| 91 | Form-locking connection |

What is claimed is:

1. An arrangement for damping and retarding (10) a movable part, comprising:

a damper housing (20) with a pressure member (50) guided in the damper housing (20) and a cylinder-piston unit (40) arranged in the damper housing (20) and in the pressure member (50), and an anchoring piece (70) supported for sliding movement in the damper housing (20) and in engagement with the pressure member (50), the anchoring piece (70) is connectable to the damper housing (20) and has elastically deformable engagement arms (74, 75) and elastically deformable transition areas, the engagement arms having two outwardly projecting gripping elements (81, 82) and also having outwardly facing engagement elements (83,84) for engagement of the anchoring piece with an engagement structure (35, 36) on the inside of the damper housing (20) for locking the anchoring piece (70) in at least two different positions, the anchoring piece (70) further including a carrier plate (73) which extends along the pressure member (50) and is provided with an anchoring lug (71) and the pressure member (50) is provided with an elongated opening (55) into which the anchoring lug (71) extends to stop movement of the pressure member (50).

2. The arrangement according to claim 1, wherein the damper housing (20) includes a mounting flange (11).

3. The arrangement according to claim 1, wherein the damper housing (20) includes at least one centering pin (12).

4. A hinge (1) including an arrangement for damping and retarding (10) a movable part, comprising:

a damper housing (20) with a pressure member (50) guided in the damper housing (20) and a cylinder-piston unit (40) arranged in the damper housing (20) and in the pressure member (50), and an anchoring piece (70) supported for sliding movement in the darner housing (20) and in engagement with the pressure member (50), the anchoring piece (70) is connectable to the damper housing (20) and has elastically deformable engagement arms (74, 75) and elastically deformable transition areas, the engagement arms having two outwardly projecting gripping elements (81, 82) and also having outwardly facing engagement elements (83,84) for engagement of the anchoring piece with an engagement structure (35, 36) on the inside of the damper housing (20) for locking the anchoring piece (70) in at least two different positions, the anchoring piece (70) further including a carrier plate (73) which extends along the pressure member (50) and is provided with an anchoring lug (71) and the pressure member (50) is provided with an elongated opening (55) into which the anchoring lug (71) extends to stop movement of the pressure member (50).

5. The hinge (1) according to claim 4, wherein the hinge is a pot hinge (1) including a hinge pot (6).

6. The hinge according to claim 5, wherein the housing (20) includes a centering pin (12) which extends into the hinge pot (6).

* * * * *